US006892505B1

(12) United States Patent
Pingitore

(10) Patent No.: US 6,892,505 B1
(45) Date of Patent: May 17, 2005

(54) PREFABRICATED FIREPLACE STRUCTURE AND METHOD

(76) Inventor: John Pingitore, 43604 N. Black Canyon, Phoenix, AZ (US) 85027

( * ) Notice: Subject to any disclaimer, the term of this patent is extended or adjusted under 35 U.S.C. 154(b) by 0 days.

(21) Appl. No.: 10/179,619

(22) Filed: Jun. 24, 2002

Related U.S. Application Data

(60) Provisional application No. 60/300,524, filed on Jun. 25, 2001.

(51) Int. Cl.[7] ..... E04B 1/00; E04G 21/00; E04G 23/00

(52) U.S. Cl. ..... 52/742.14; 264/32; 264/34; 264/36

(58) Field of Search ..... 52/32, 34, 36, 52/264, 742.14

(56) References Cited

U.S. PATENT DOCUMENTS 3,301,249 A * 1/1967 Hendricks ..... 126/554
3,339,540 A * 9/1967 Kreider
3,488,901 A * 1/1970 Peterschmidt ..... 52/81.3
3,721,225 A * 3/1973 Tidwell ..... 126/120
3,820,292 A * 6/1974 Fitzpatrick ..... 52/81.5
4,016,859 A * 4/1977 Landowski ..... 126/518
4,144,680 A * 3/1979 Kelly ..... 52/81.4
4,384,566 A * 5/1983 Smith ..... 126/121
4,422,438 A * 12/1983 Scholz et al. ..... 126/120
4,488,392 A * 12/1984 Pearcey et al. ..... 52/741.11
5,094,044 A * 3/1992 Dykmans ..... 52/80.1
5,263,603 A * 11/1993 McBride ..... 220/567.2
6,109,257 A * 8/2000 Hodge et al. ..... 126/500

* cited by examiner

*Primary Examiner*—Carl D. Friedman
*Assistant Examiner*—Yvonne M. Horton
(74) *Attorney, Agent, or Firm*—Gregory J. Nelson

(57) ABSTRACT

A method of construction of structures such as large, decorative pots, water features and outdoor free-standing fireplaces. The method comprises pouring a concrete base to which a skeletal reinforcing structure in the desired shape is set. Thereafter, metal screen and a cementitious material is applied over the skeletal structure to form a shell. Openings may be formed either when shaping the shell or later by cutting away areas of the steel skeletal structure. Suitable decorations such as graphics may be applied using stains, dyes or carving techniques.

5 Claims, 4 Drawing Sheets

PREFABRICATED FIREPLACE STRUCTURE AND METHOD

CROSS REFERENCE

This application is based on provisional application Ser. No. 60/300,524 filed Jun. 25, 2001, entitled "Prefabricated Fireplace Structure and Method."

FIELD OF THE INVENTION

The present invention relates to decorative structures and construction methods and more particularly to the method of construction of free-standing, prefabricated outdoor structures having a Southwestern appearance, such as fireplaces as well as pots and fountains.

BACKGROUND OF THE INVENTION

Fireplaces are widely used and enjoyed not only for the heat they generate but for cooking purposes and for the ambiance that they lend to an area. Outdoor fireplaces are very popular and are often installed on patio areas in both homes and commercial establishments, such as restaurants, to add warmth and charm to the atmosphere. Fireplaces, particularly outdoor fireplaces, may be of various stales and types. A simple patio fireplace may consist of a cast iron receptacle in which logs, either natural or artificial, are burned. Fire pits are also popular. Fire pits are usually constructed having a cylindrical outer wall of block or brick and may be lined with a fire brick. The area within the wall is filled with sand and logs or other combustible material may be burned within the fire thus created. More sophisticated fire pits may include a gas pipe having jets connected to a source of gas such as natural gas or bottles of propane or butane. An annular pipe is generally placed a few inches below the sand so that the flames emanate from the sand providing a pleasing visual effect.

In certain areas of the United States, particularly the Southwest, an outdoor fire place having the appearance modeled after fire places found in Central and South America are also popular. These fireplaces are sometimes termed "chimeneas." These styles of fireplaces are often fabricated from materials such as clay, which have been fired to resist heat. Generally, these fireplaces are relatively small and only at most being several feet high defining a fire box at the lower end and having an upstanding flue. The overall shape of a chimenea is similar to an inverted funnel.

The individual wishing to have a chimenea must either generally purchase a smaller-type fireplace or chimenea as described above, or if a larger unit is desired, must have such a fireplace constructed onsite of block and then finished by an application of stucco. For larger prefabricated fireplace and chimney assemblies were of the more traditional type. For example, U.S. Pat. No. 4,016,859 shows a representative prefabricated fireplace structure. This patent shows a preformed or precast fireplace stack having an intricately-molded hearth, smoke chamber and chimney flue as well as a sub-mantle. A stack base includes one or more flues which can communicate with the flue passages in the fireplace stack. A chimney stack extension may be supported at the top of the fireplace stack is provided with fluids which register with the fireplace flu. Other preformed parts may include a fire clay insert which goes in the combustion chamber, a preformed mantle with simulated brick facing and simulated brick columns or corner posts, which together with the mantle, surround the fireplace opening.

In addition to fireplaces, other structures such as planters, decorative pots and waterfalls are popular with landscapers and homeowners. These too are generally either fabricated from cement or clay often replicating Native American pottery styles.

In view of the foregoing, there exists a need for a preformed or prefabricated fireplace, pot and waterfall structures which can be manufactured offsite and brought to the installation site in a completed condition. There further exists a need for such structures having the general appearance of the popular southwestern chimenea style, but which are much larger and may be used on a large patios and outdoor areas.

BRIEF SUMMARY OF THE INVENTION

Briefly, the present invention provides a method for constructing a structure which first involves forming a structural component such as rebar or pencil into ribs or stringers defining the exterior and interior shape of the fireplace. The ribs are interconnected by rings at spaced-apart locations by wiring or other connection methods. A masonry base is poured in a form. Generally the base is circular, but may take other configurations. The ribs are placed into the base once it is poured with the lower end of the ribs depending into the concrete before the concrete is set. The concrete is allowed to set and thereafter lathe or metal screen is applied to the inner and outer wall surfaces defined by the ribs. Once the lathe is in place, one or more coatings of stucco are applied to the inner and outer surfaces of the shell. The stucco may include suitable bonding and coloring agents. The finish coat, which may consist of silica sand, is then applied at least to the exterior.

In the case of a fireplace, fire brick may be applied to the interior surface in the area of the fire box. Other features such as a hearth of flagstone or other material may be placed on the floor of the firebox extending horizontally outward from the firebox. A decorative graphic may be applied either by painting into the exposed surfaces, carving or applying a stain or dye.

If an opening having an unusual or irregular shape is required, a jig or pattern may be used as a guide when cutting out part of the shell.

BRIEF DESCRIPTION OF THE DRAWINGS

The above and other advantages of the present invention are more apparent from the following description and drawings in which.

DETAILED DESCRIPTION OF THE DRAWINGS

Figure 1:
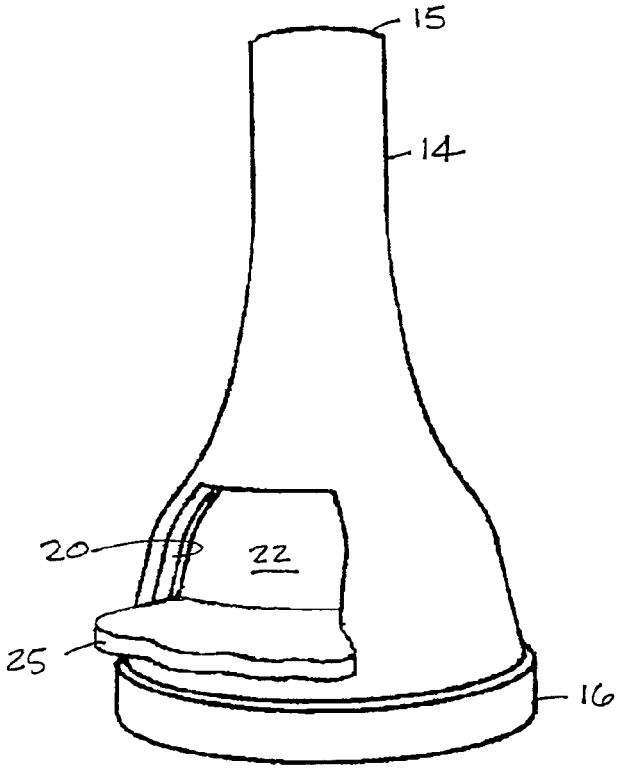
FIG. 1 is a perspective view of a completed fireplace quoting the present invention.

Turning now to drawing FIGS. 1 to 6, the completed structure shows a fireplace is generally designated by the numeral 10, is seen in FIG. 1. The completed fireplace as seen has a generally downward and outwardly diverging shape in the nature of an inverted funnel. The fireplace defines a flue 14 which opens its upper end is for exhausting the products of combustion. The fireplace rests on a base 16, which is shown as being circular, or may be any other shape. Opening 20 provides access to the firebox 22. The firebox 22 may be lined with a suitable firebrick. A hearth 25 may extend outwardly from the bottom of the firebox.

Figure 2:
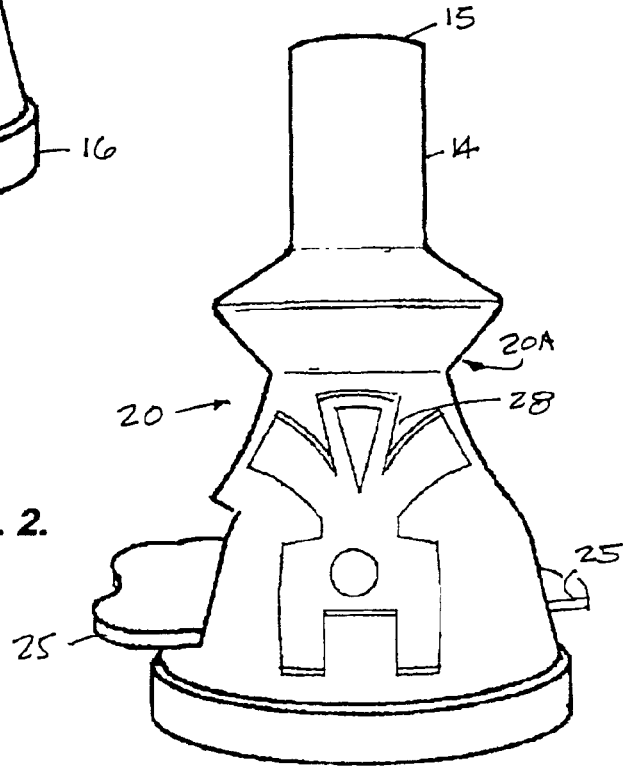
FIG. 2 is a perspective view of another embodiment of a fireplace constructed in accordance with the invention.

In some instances, as seen in FIG. 2, openings 20, 20A access the fire box may be provided on opposite sides of the body of the fireplace so that the fire may be attended and enjoyed from opposite sides. Suitable graphics or design images 28 may be placed on the exterior of the body. Typically, the overall height of the fireplace may vary, but generally is between 4–8 feet and when completed may weigh as much as several thousand pounds. However, the completed structure may be transported to the installation location by truck and simply set in place manually or using a fork lift or other device. The prefabricated structure has the appearance of a chimenea with the convenience of being prefabricated, not requiring the inconvenience of attended onsite fabrication.

Figure 3:
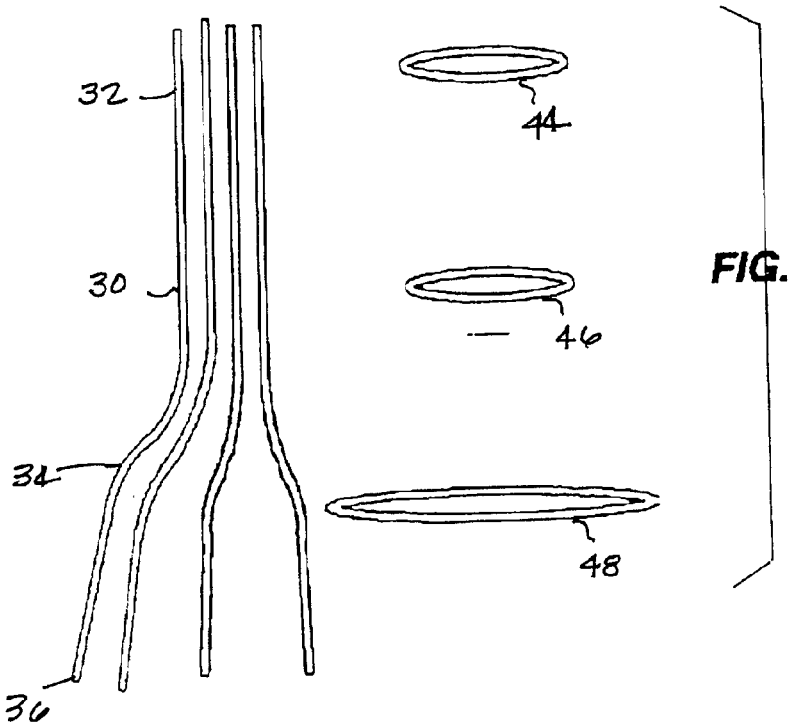
FIGS. 3 to 6 show the sequential steps of fabrication of the fireplace in accordance with the method of the present invention.
Figure 4:
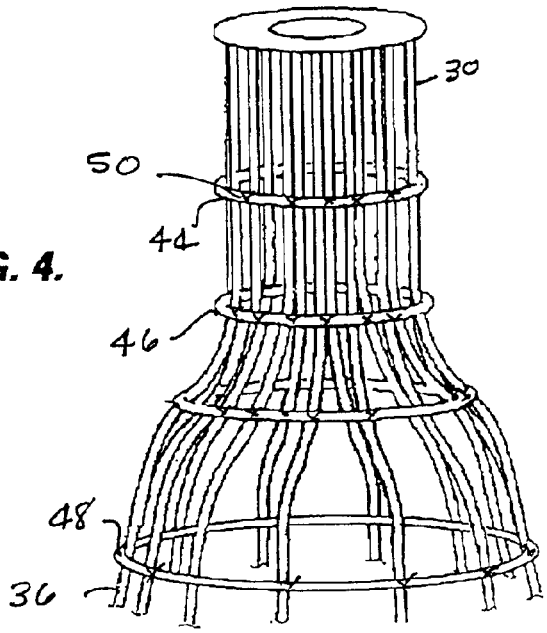
Figure 5:
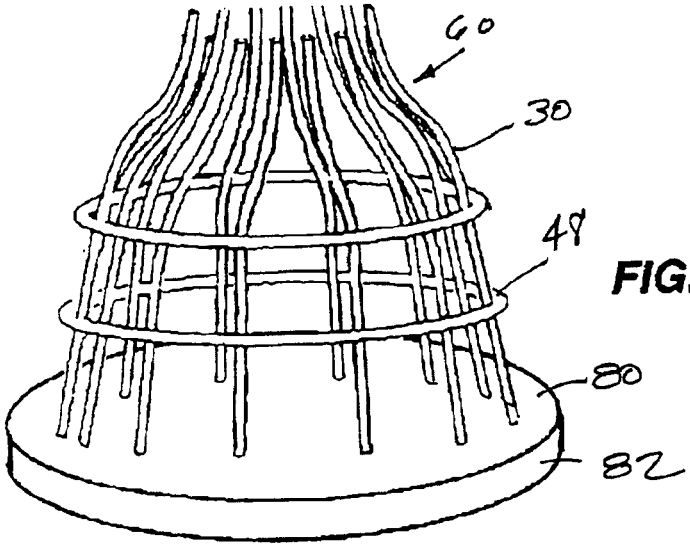
Figure 6:
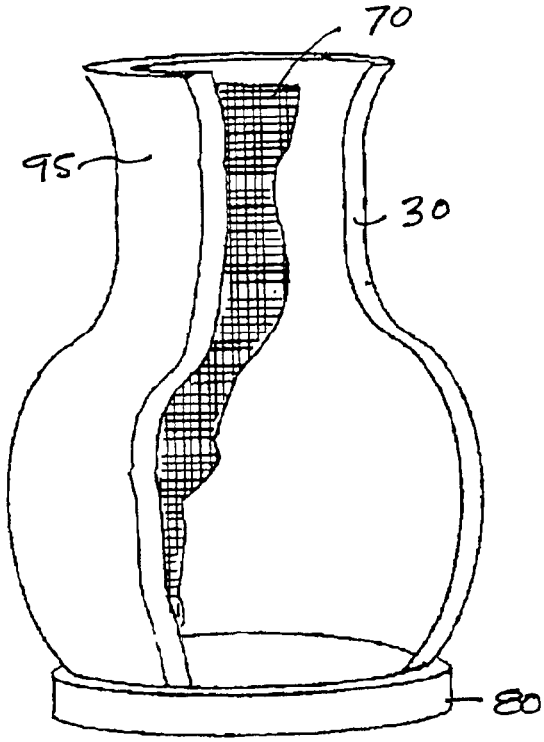

Turning now to FIGS. 3 and 5, the method of construction of a fireplace is shown in detail and is representative of the fabrication of other structures such as pots or water features. The modular construction first involves the forming of vertical ribs 30 into the desired shape. In the fabricated structure, the ribs will have a generally curved shape, having an upper end 32, an arching intermediate section 34 and a lower depending end 36. Generally the curve will extend outwardly so that in the completed fireplace, the lower portion is substantially larger in diameter than the upper section. The upper section defines the flue 14. The ribs can be fabricated from any suitable material, such as ⅜ rebar, which is the preferred material. Note that the ribs are fabricated to define both the exterior and interior surface of the structure. Generally the wall thickness will be at least several inches thick.

Once the ribs have been formed, they are connected to form a skeleton structure defining both the exterior and interior walls of the structure. The ribs are joined together by a plurality of rings 44, 46 and 48, which may also be formed from a suitable material such as rebar. The rings and the ribs can be bent into the desired shape using conventional bending techniques that are used for shaping rebar material. The rings are secured at spaced-apart locations which may vary from about 6–30 inches apart, depending on the overall size of the completed structure. The rings are secured to the ribs by any suitable attachment method preferably using wire or wire ties 50 at the intersection of the ribs and rings. Note the ribs and rings are assembled to define the skeleton structure 60 for both the interior and exterior walls. The lower end 36 of the ribs are fabricated to depend vertically, generally 2–4 inches below the lowermost ring.

The next step is to fabricate the base, refer to FIG. 5. The base 80 generally will be made from a cementitious material such as concrete and will be typically about 4 inches thick. The base may be any shape, but generally will be circular conforming to the circular shape of the structure at its base. The base is generally slightly larger in diameter then the base of the fireplace so that an annular rim extends around the base of the fireplace. The base is fabricated in a form in a conventional manner incorporating 3 or 4 pick-u hooks which may be attached to a lifting cable. Once the base material has been poured into the form 82 and leveled, the skeleton structure of the chimney is positioned on the base with the depending lower end of the ribs penetrating the concrete. The concrete is then allowed to set and the base and the skeletal frame are now a unitary structure. The base may be removed from its form and the structure is now ready for application of lathe 70, sometimes termed metal screen. The metal screen is formed from wire, has a small opening and is easily shapeable. The wire, screen or mesh is applied to both the interior and exterior surfaces defined by the skeletal structure. The ribs 30 will be secured in place by suitable fastening means such as use of wire.

Once the screen has been secured to the skeletal frame, stucco layer 95 can be applied both to the interior and exterior surfaces over the metal lathe. Stucco, a generally cementitious mixture may include suitable coloring and bonding agents as well as accellerants. In some applications, particularly for larger structures, an additional layer of lathe may be applied after the additional layer of stucco. The stucco can be applied by spraying or spreading techniques or by hand application and is built up until the desired thickness is achieved, generally 2–3 inches. The stucco is allowed to air dry or may be dried in a large drying area. Different environmental conditions do not facilitate air drying.

The structure is now ready for a finish coat. Generally the finished coat will consist of a stucco finish including a fine silicate sand which provides a natural and appealing Southwestern look. In some instances, in the case of a lower area of the fireplace may be lined with a suitable fire brick for durability. It may also be the desire to place a horizontal floor or bottom in the fire box. As shown, this consists of a section of material such as natural stone. It is preferred that the firebox floor extend beyond the opening of the fire box to form a horizontal ledge or hearth 60. This hearth feature adds to the appearance to the functionality of the completed fire place. The hearth provides a location in which individuals can sit while enjoying the fire and also a location for stacking combustible materials to be burned, such as logs.

If desired, the exterior surface of the structure maybe provided with suitable graphics as seen in FIG. 2, such as graphics having comparative symbols used by Native Americans. These symbols can be painted on the exterior of the fireplace or may be formed by compressing them in the still wet stucco or later carving them. Colorants, such as concrete acid stains and dyes may also be applied.

The foregoing described technique of fabricating modular masonry structures, relates specifically to a fireplace, however, it will be obvious that this construction technique is not limited to fireplaces and may be used for fabricating other structures such as pottery, furniture items, water features and even fountains. The construction technique allows a wide latitude in the completed shape of the item and provides the convenience of allowing items, even large items such as fireplace and waterfall features, to be fabricated off-site and installed at the location with a minimal of inconvenience to the property owners.

Figure 7:
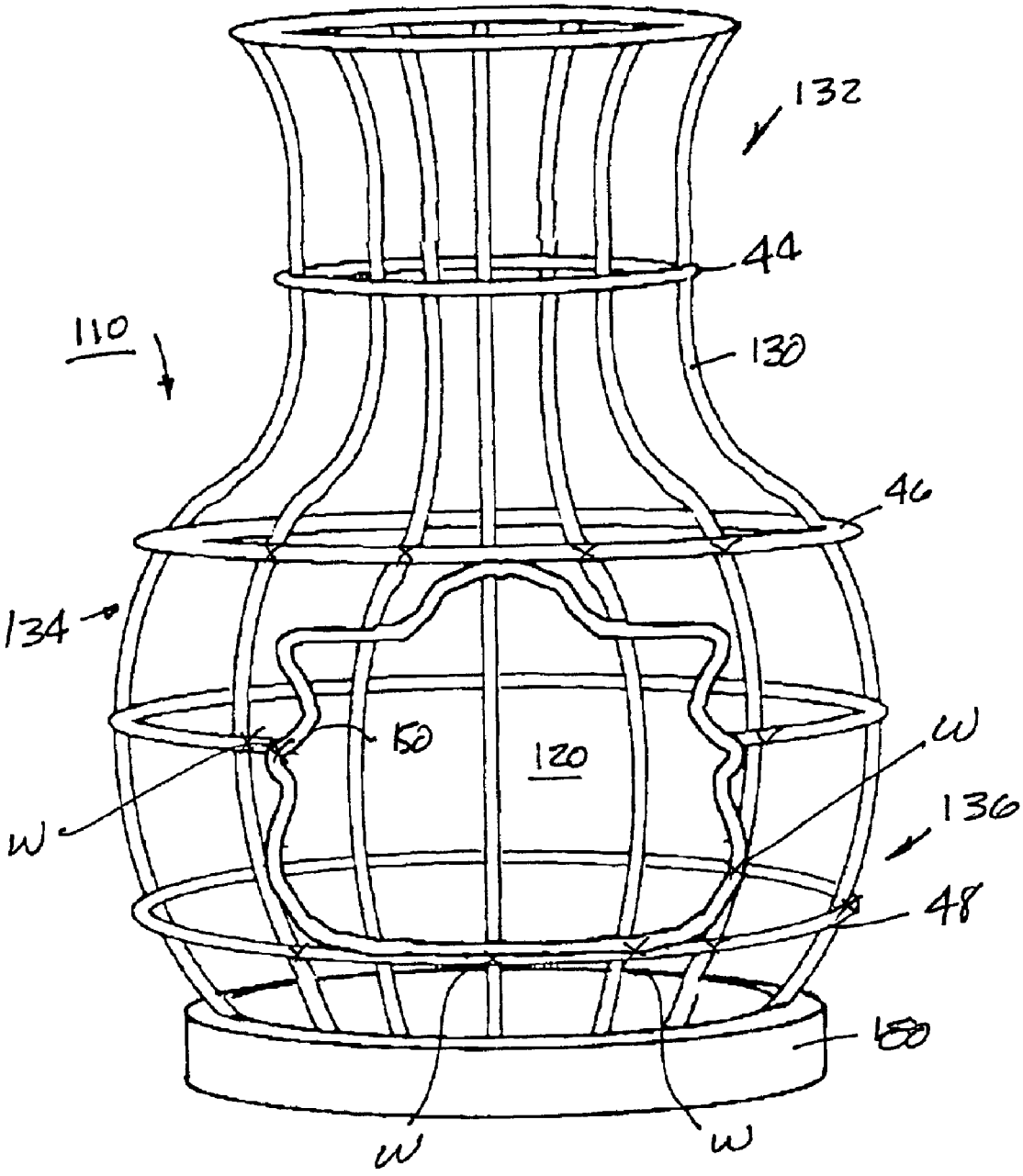
FIG. 7 shows a pot fabricated according to the invention having an opening which was cut out of the shell using a jig.

Referring to FIG. 7, a large pot 110 has been constructed in accordance with the present invention. The pot 110 has a base 180 formed of concrete and a curved shell or body having an upper section 132, intermediate section 134 and lower end 136. The shell has been shaped using a skeletal reinforcing structure to having vertical ribs 130 and rings 144, 146 and 148 which are welded or secured in the desired position by wire ties. In this case, an opening 120 of irregular shape is desired in the completed structure.

Since opening 120 is irregular in shape, it is formed by securing a jig 150 to the shell surface by welding at welds "W." The section of the ribs and rings within opening area 120 are cut away with a cutting torch or tool leaving the opening. Thus the jig 150 defines the shape of the opening 120 and also permanently remains as part of the skeletal structure. The jig is formed from re-bar or pencil bar by conventional bending and shaping technique and finished by applying stucco or other material. Decorative designs may also be incorporated using stains, dyes or by carving.

It will be obvious that those skilled in the area will make various changes, alterations and modifications to the invention described herein. To the extent these various alterations, modifications and changes do not depart from the spirit or scope of the patented claims, they are intended to be encompassed therein.

I claim:

1. A method of forming a prefabricated structure comprising:

(a) forming a plurality a steel rods having upper and lower ends into a curved shape defining a shell of predetermined shape;

(b) securing a jig having a predetermined shape to the shell and cutting out a section of the shell using said jig as a pattern to form an opening in the shell whereby the jig serves as a guide and remains as part of the shell;

(c) placing the lower end of the rods in a wet cement base to form an upwardly converging shell structure integral with the base;

(d) securing generally horizontal reinforcing members at space-apart locations to form a skeleton structure;

(e) covering said skeleton structure with metal screen; and (f) applying at least a layer of cementitious material over said screen to form said prefabricated structure.

2. The method of claim 1 wherein said graphics are applied to said structure using a colorant.

3. The method of claim 1 wherein graphics are applied to said structure by carving said shell.

4. The method of claim 1 wherein said jig is formed from the group of material consisting of rebar and pencil bar.

5. A method of forming a prefabricated structure comprising:

(a) forming a plurality a steel rods having upper and lower ends into a curved shape defining a shell of predetermined shape;

(b) placing the lower end of the rods in a wet cement base to form an upwardly converging shell structure integral with the base;

(c) securing generally horizontal reinforcing members at space-apart locations to form a skeleton structure;

(d) covering said skeleton structure with metal screen;

(e) applying at least a layer of cementitious material over said screen to form said prefabricated structure; and (f) applying graphics to the exterior of the structure using a colorant.

* * * * *